United States Patent [19]

Hausmann

[11] Patent Number: 5,062,949

[45] Date of Patent: Nov. 5, 1991

[54] DEFORMABLE SIEVE MAT SCREENING APPARATUS HAVING RAISED SIEVE MAT RIMS

[75] Inventor: Herbert Hausmann, Cleisdorf, Austria

[73] Assignee: Binder & Co. Aktiengesellschaft, Gleisdorf, Austria

[21] Appl. No.: 554,207

[22] Filed: Jul. 17, 1990

[30] Foreign Application Priority Data

Jul. 21, 1989 [AT] Austria ..... 1765/89

[51] Int. Cl.[5] ..... B07B 1/30; B07B 1/46

[52] U.S. Cl. ..... 209/310; 209/363; 209/403

[58] Field of Search ..... 209/310, 341, 363, 364, 209/397-399, 401-403

[56] References Cited

U.S. PATENT DOCUMENTS

| | | | |
|---|---|---|---|
| 2,329,773 | 9/1943 | Leahy | 209/310 |
| 3,971,715 | 7/1976 | Wehner | 209/310 |
| 4,064,051 | 12/1977 | Wehner | 209/310 X |
| 4,248,701 | 2/1981 | Wenzel | 209/310 X |
| 4,348,275 | 9/1982 | Backman | 209/310 |
| 4,504,386 | 3/1985 | Dyren et al. | 209/254 |

FOREIGN PATENT DOCUMENTS

| | | | |
|---|---|---|---|
| 0002993 | 8/1900 | Austria | 209/310 |
| 0386137 | 12/1987 | Austria . | |
| 0387342 | 6/1988 | Austria . | |
| 0209777 | 1/1987 | European Pat. Off. | 209/363 |
| 2108924 | 9/1972 | Fed. Rep. of Germany | 209/310 |
| 3139279 | 4/1983 | Fed. Rep. of Germany . | |
| 3521753 | 12/1986 | Fed. Rep. of Germany | 209/403 |

*Primary Examiner*—Michael S. Huppert
*Assistant Examiner*—Edward M. Wacyra
*Attorney, Agent, or Firm*—Collard, Roe & Calgano

[57] ABSTRACT

A screening apparatus comprises an elongated support frame; a mobile, deformable sieve consisting of a sieve mat extending along the length of the support frame and having lateral edges; and a series of alternatingly immobile and mobile sieve mat carriers mounted on the support frame and extending transversely to the length of the support frame, the sieve mat being affixed to the carriers and the mobile carriers being movable with respect to the support frame in the direction of the length of the support frame, the lateral sieve mat edges extending transversely to the carriers and being raised to form rims for the sieve mat.

3 Claims, 3 Drawing Sheets

DEFORMABLE SIEVE MAT SCREENING APPARATUS HAVING RAISED SIEVE MAT RIMS

BACKGROUND OF THE INVENTION

1. Field of the Invention

The present invention relates to a screening apparatus comprising an elongated support frame; a mobile, deformable sieve consisting of a sieve mat and having lateral edges extending in the direction of the length of the support frame; and a series of alternatingly immobile and mobile sieve mat carriers mounted on the support frame along the length thereof, the sieve mat being affixed to the carriers and the mobile carriers being movable with respect to the support frame in the direction of the length of the support frame.

2. Description of the Prior Art

Austrian Patents Nos. 386,137 and 387,342 disclose screening apparatus in which seals are arranged between the sieve mats and adjacent side walls of the support frame to prevent coarse grains from penetrating below the sieves. Such gliding seals always constitute a weak point in the screening apparatus. In addition to the wear of the seals, the required changes of the sieves cause malfunctions because of the necessary accurate fit.

In other known screening apparatus of this general type, finely porous, elastic materials affixed to the support frame side walls are used as seals between the sieve mats and the adjacent support frame side walls. Because of the rapid destruction of such sealing materials by the goods being sifted, such screening apparatus has an unacceptably short operating life.

SUMMARY OF THE INVENTION

It is the primary object of this invention to overcome the indicated disadvantages and to provide a screening apparatus which not only dependably prevents any passage of coarse grains below the sieves but which also is not subject to wear of seals and the like. In addition, the apparatus of the invention may be operated readily by unskilled personnel.

The above and other objects are accomplished in a screening apparatus of the first-described structure with the lateral sieve mat edges extending transversely to the carriers being raised to form lateral rims for the sieve mats.

According to a preferred feature, the carriers have support shoulders for the raised sieve mat rims, the support shoulders having an arcuate transition section. This assures a solid fastening on the support frame side walls and, in particular, effectively prevents a sharp bending of the side walls. The support frame has side walls adjacent the raised sieve mat rims which are raised substantially above the adjacent support frame side walls. In this preferred embodiment, the raised sieve mat rims actually constitute the sieve side walls. In this manner, the movement and the deformation of the sieve mat is least hindered. Friction losses are thus minimized and the operating lives of the sieve mats are considerably prolonged.

Preferably, reinforcement ledges extend along the raised sieve mat rims and are affixed to the raised sieve mat rims in the range of the immobile carriers. This provides an extremely robust, heavy-duty construction while providing a considerable range of movement for the sieve mats.

It is also preferred to leave the raised sieve mat rims free of perforations. This prevents any fines penetrating between the raised sieve mat rims and the fixed support frame side walls from causing wear due to the relative movement thereof.

BRIEF DESCRIPTION OF THE DRAWINGS

The above and other objects, advantages and features of the present invention will become more apparent from the following detailed description of now preferred embodiments thereof, taken in conjunction with the accompanying, somewhat schematic and fragmentary drawings wherein.

DETAILED DESCRIPTION OF PREFERRED EMBODIMENTS

Figure 1:
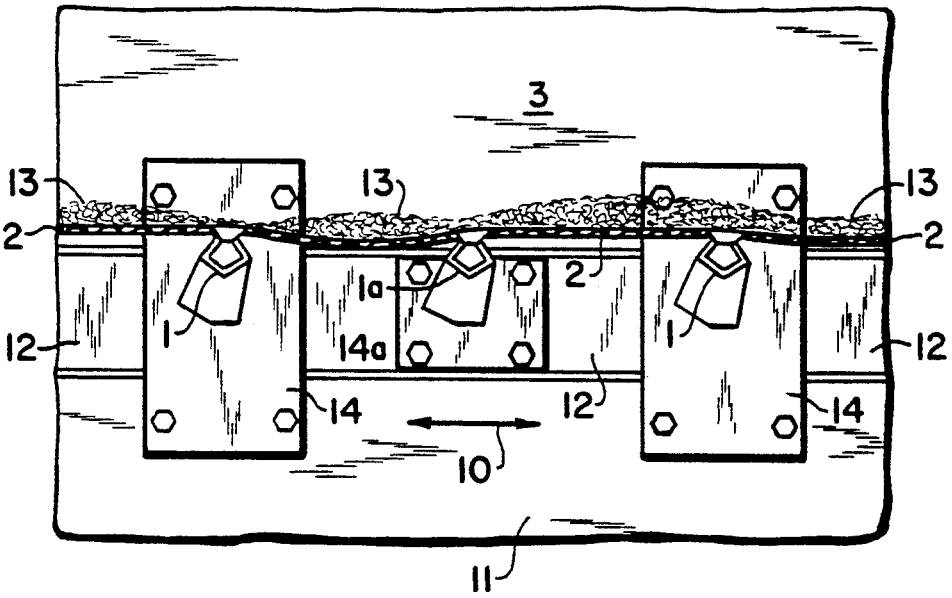
FIG. 1 is a vertical section showing one embodiment of the screening apparatus.
Figure 2:
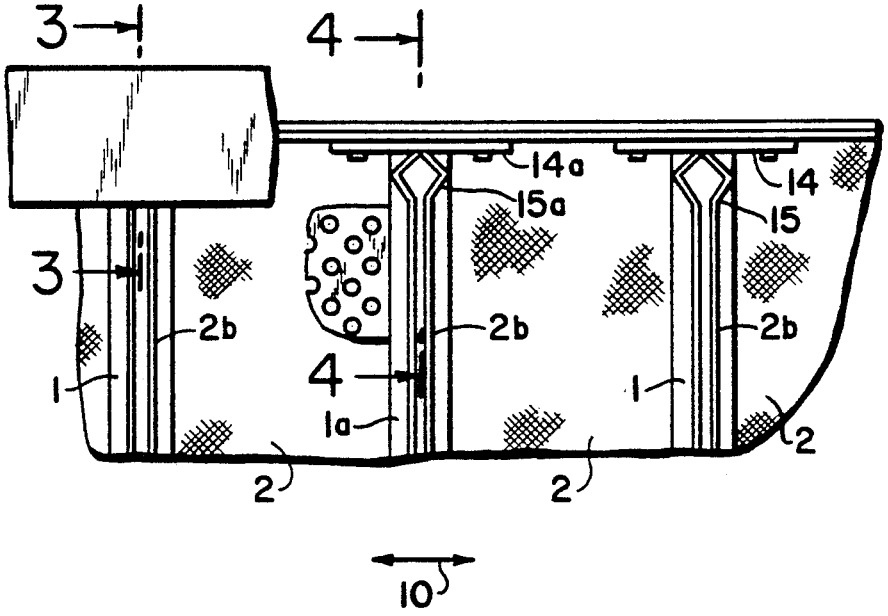
FIG. 2 is a fragmentary top view of the apparatus.

Referring now to the drawing and first to FIGS. 1 and 2, there is shown a screening apparatus comprising elongated support frame 11 and a series of sieve carriers 1, 1*a* distanced from each other in the direction of the length of the support frame and affixed to the support frame. Sieve carriers 1, 1*a* are hollow profiles whose two opposite ends are welded to end plates 14, 14*a* and which extend transversely to the length of support frame 11. The end plates of the sieve carriers are screwed or otherwise fastened to support frame 11 and support frame side walls, respectively (see FIGS. 3 and 4). A mobile sieve carrier 1*a* is arranged between pairs of immobile sieve carriers 1 and is reciprocable in the direction of the length of the support frame, as indicated by double-headed arrow 10 in FIG. 1. Mobile sieve carriers 1*a* have the same structure as immobile sieve carriers 1. End plate 14*a* of the mobile sieve carriers 1*a* is screwed or otherwise fastened to mobile carrier 12 which extends in the longitudinal direction of the screening apparatus. Sieve mat 2 is fastened to sieve carriers 1, 1*a* by means of clamping bars 15, 15*a*, which are affixed to the respective sieve carriers, and is alternately tensioned and relaxed in different sections thereof by the movement of mobile sieve carrier 1*a*. In this way, material 13 to be sifted is set in motion whereby it is caused to pass through the sieve mat. Spilling of material 13 in a direction extending transversely to the axes of sieve carriers 1, 1*a* is limited by side walls 3. The plane of the sieve is generally horizontal or slightly inclined. The drive of the reciprocating sieve carriers 1*a* and the feeding of the material to be sifted are conventional and are not shown.

In the embodiment illustrated in FIGS. 1 to 4, end plates 14 welded to sieve carriers 1 are fixedly attached to support frame 11 of the generally conventional screening apparatus (not further shown). Mobile sieve carrier or carriers 1*a* is or are reciprocable in a direction extending transversely to the axis or axes of thereof, as shown by double-headed arrow 10. End plates 14*a* welded to the mobile sieve carrier or carriers are screwed to U-shaped carrier beam 16 extending in the longitudinal direction of the screening apparatus. This carrier beam is supported on support frame 11 and side wall 3 of the support frame by rubber grommets 17, 17. These rubber grommets permit the carrier beam and thus the mobile sieve carrier(s) fastened thereto to move in the longitudinal direction of the screening apparatus.

Sieve mat 2 is clamped to sieve carriers 1, 1*a* by clamping bars 15, 15*a*, forming folds 2*b*. Clamping bars 15, 15*a* rest on the sieve carriers along their entire lengths, except for the edges, and are affixed thereto. However, the clamping bars are raised along side walls 3. The reciprocating movement of sieve carrier(s) 1*a* causes different sections of sieve mat 2 to be tensioned and relaxed, and thereby to set material 13 to be sifted into motion, thus producing an efficient passing of the material through the sieve mat. Raised side walls 3 along the sides of the screening apparatus limit the screening plane laterally so as to prevent an overflow of the material in lateral edge areas 4. According to the invention, lateral edges 2*a* of sieve mat 2 are raised along the side walls and these raised sieve mat rims are screwed or otherwise fastened to the side walls along the immobile sieve carriers 1 while they remain detached in the area of mobile sieve carrier(s) 1*a* so as to leave these sieve carriers free to move. Side walls 3 define recess 5 capable of receiving raised rims 2*a* of sieve mat 2 and the sieve mat is guided in the recesses of the side walls.

Figure 3:
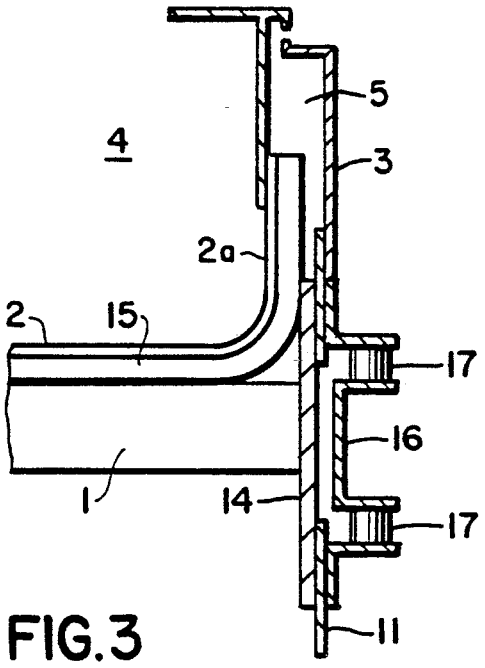
FIGS. 3 and 4, respectively, are sections along lines III—III and IV—IV of FIG. 2.
Figure 4:
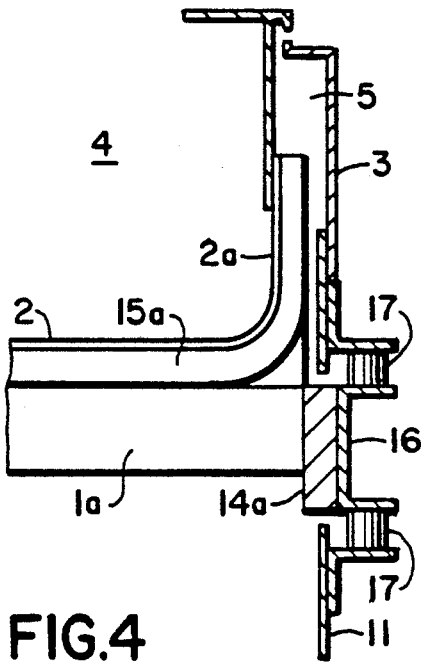
Figure 6:
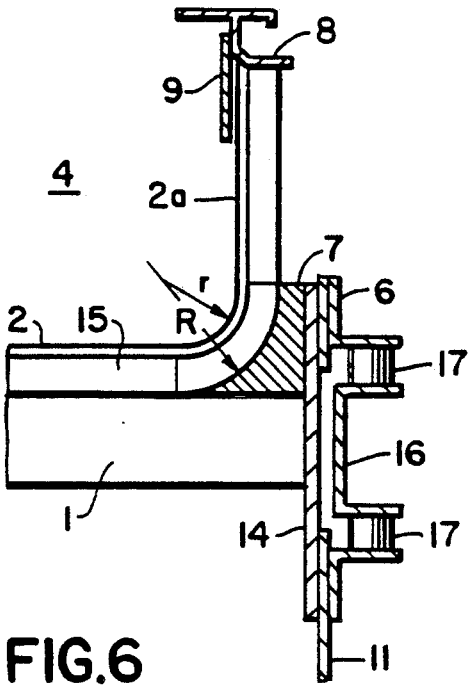
FIGS. 6 and 7, respectively, are sections along lines VI—VI and VII—VII of FIG. 5.
Figure 7:
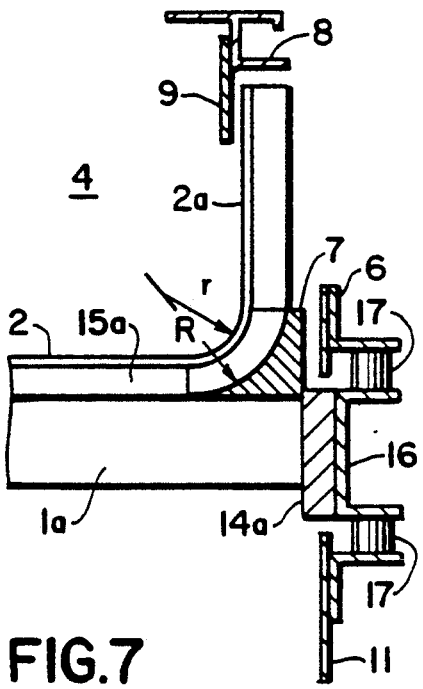
Figure 5:
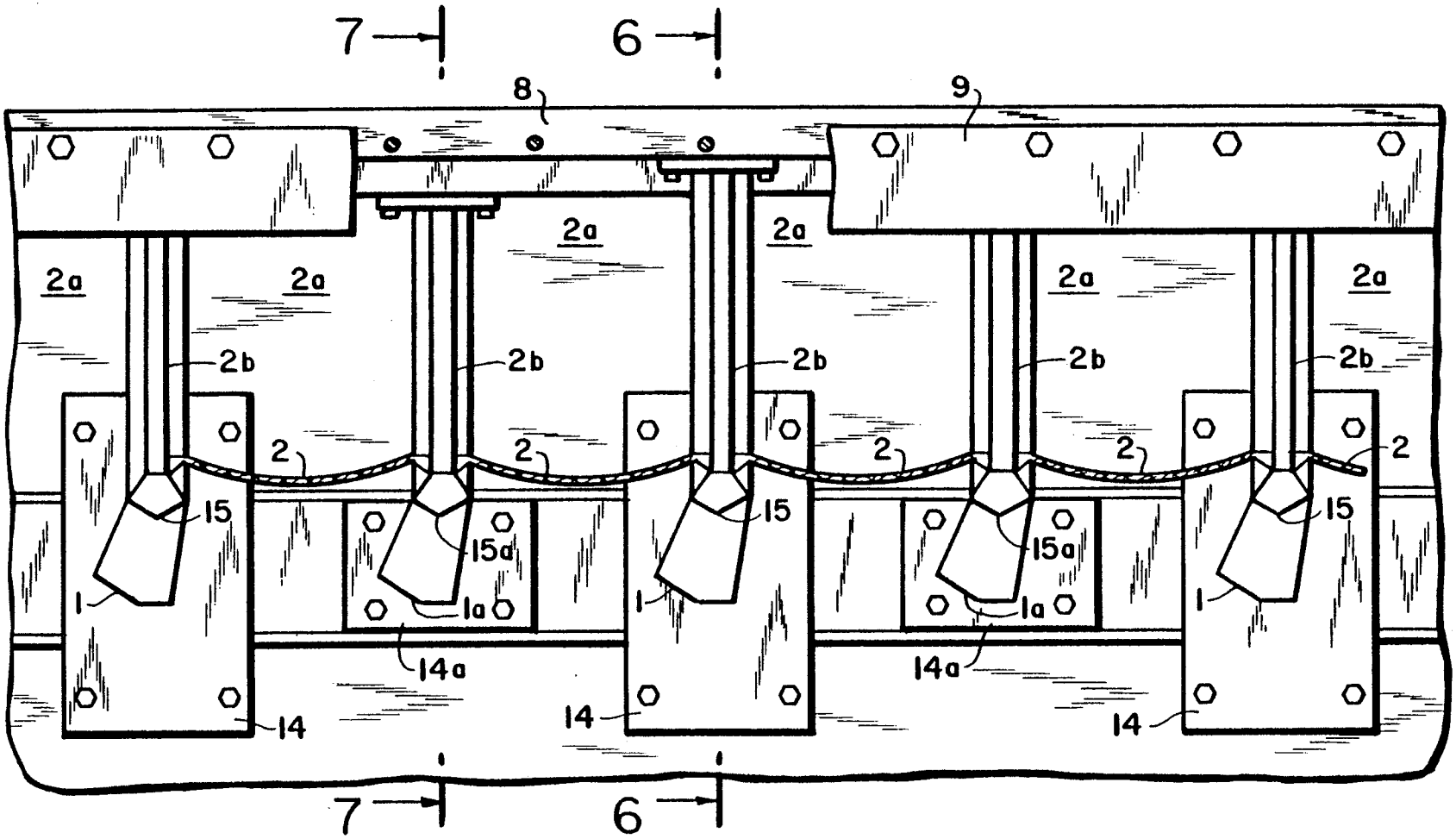
FIG. 5 is a longitudinal section of another embodiment of the screening apparatus.

In the embodiment of FIGS. 5 to 7, side walls 6 affixed to support frame 11 extend only a little above the sieving plane defined by sieve mat 2. Thus, the actual lateral limiting side walls for the material to be sifted is constituted solely by raised rims 2*a* of the sieve mat, which are held in position by the perpendicularly extending edge sections of clamping bars 15, 15*a*. Arcuate support shoulders 7 having a transition radius R are arranged along the edges of the sieve carriers. This arcuate transition shoulder prevents sieve mat 2 from being sharply bent in its transition between the horizontal section and the raised rims. Transition radius r of sieve mat 2 is smaller than transition radius R of support shoulder 7 by the thickness of clamping bars 15, 15*a*. The fastening of mobile sieve carrier(s) 1*a* to U-shaped carrier beams 16 is effected in the same manner as shown in FIGS. 2 to 4.

Since raised rims 2*a* of sieve mat 2 project substantially above the fixed low side walls 6 fastened to support frame 11, reinforcement ledge 8 is arranged to extend along each raised rim and is screwed to the raised rim in the areas of immobile sieve carriers 1. Protective ledge 9 is screwed or otherwise fastened to reinforcement ledge 8 and projects downwardly therefrom alongside the inside of the raised rim to prevent penetration of the material being sifted between reinforcement ledge 8 and sieve mat 2. Raised rims 2*a* of the sieve mat have no perforations so that no material can pass uncontrollably laterally out of the sieve mat.

The above-described screening apparatus has movable sieves which may be substantially deformed without requiring any seals between relatively movable parts, thus assuring a simple construction and a long operating life.

What is claimed is:

1. A screening apparatus comprising:
(a) an elongated support frame;
(b) a mobile, deformable sieve consisting of a sieve mat extending along the length of the support frame and having lateral edges; and
(c) a series of alternatingly immobile and mobile sieve mat carriers mounted on the support frame and extending transversely to the length of the support frame, the sieve mat being affixed to the carriers and the mobile carriers being movable with respect to the support frame in the direction of the length of the support frame, the lateral sieve mat edges extending transversely to the carriers and being raised to form rims for the sieve mat, the carriers having support shoulders for the raised sieve mat rims which are free of perforations, and the support shoulders having an arcuate transition section.

2. The screening apparatus of claim 1, wherein the support frame has side walls adjacent the raised sieve mat rims, the sieve mat rims being raised substantially above the adjacent support frame side walls.

3. The screening apparatus of claim 2, further comprising reinforcement ledges extending along the raised sieve mat rims and being affixed to the raised sieve mat rims in the range of the immobile carriers.

* * * * *